US007384186B2

(12) United States Patent
Williams

(10) Patent No.: US 7,384,186 B2
(45) Date of Patent: Jun. 10, 2008

(54) MOUNTABLE REUSABLE PAINT CONTAINER WITH SPIGOT ASSEMBLY AND STIRRING MECHANISM

(75) Inventor: Timothy J Williams, Portland, OR (US)

(73) Assignee: Timothy J. Williams, Portland, OR (US)

( * ) Notice: Subject to any disclaimer, the term of this patent is extended or adjusted under 35 U.S.C. 154(b) by 423 days.

(21) Appl. No.: 09/579,938

(22) Filed: May 26, 2000

(65) Prior Publication Data

US 2003/0133356 A1 Jul. 17, 2003

(51) Int. Cl.
*B01F 7/20* (2006.01)
*B01F 15/02* (2006.01)

(52) U.S. Cl. ..... 366/192; 366/194; 366/245; 366/247; 366/605; 222/185.1

(58) Field of Classification Search ..... 222/185.1; 220/23.4; 366/192, 194–196, 204, 245, 247, 366/605
See application file for complete search history.

(56) References Cited

U.S. PATENT DOCUMENTS 101,936 A * 4/1870 Stephens
316,594 A * 4/1885 Adami
1,101,199 A * 6/1914 Legg et al.
1,254,429 A * 1/1918 Parmeley
2,269,736 A * 1/1942 Rogers
2,802,649 A * 8/1957 Stockton
2,848,019 A * 8/1958 Corbin et al. ..... 141/100
2,951,617 A * 9/1960 DeBrock ..... 222/644
3,602,400 A * 8/1971 Cooke
4,311,017 A * 1/1982 Reed et al.
4,656,840 A * 4/1987 Loofbourrow et al.
5,094,543 A * 3/1992 Mursa
5,335,829 A * 8/1994 Sovann
5,368,387 A * 11/1994 Creighton et al.
5,381,916 A * 1/1995 Stawder
5,400,916 A * 3/1995 Weber
5,407,270 A * 4/1995 Barlie et al.
5,630,666 A * 5/1997 Rodriguez
5,673,817 A * 10/1997 Mullen et al.
5,829,344 A * 11/1998 Lande
5,842,606 A * 12/1998 DeVito
5,855,304 A * 1/1999 Dean et al.

(Continued)

OTHER PUBLICATIONS

Cole Parmer's Food TechSource 2002.*

*Primary Examiner*—David L Sorkin
(74) *Attorney, Agent, or Firm*—Haverstock & Owens LLP

(57) ABSTRACT

A mountable reusable paint container is configured for mounting on a wall and includes one or more separate storage compartments formed in a downward sloping configuration with each compartment having a spigot coupled at the base for dispensing the stored paint product. The paint container further includes molded air tight lids configured for fitting over each of the compartments. Each of the paint containers preferably have a stirring mechanism formed within the lid which extends into the paint container when the lid is positioned over the paint container. The stirring device extends downward into the reusable paint container and includes a top handle portion, a threaded distance rod and a bottom fin portion. The bottom fin portion includes a plurality of small evenly spaced fins formed of plastic which rotate with the stirring device in the paint container when the top handle portion is manually activated.

28 Claims, 5 Drawing Sheets

U.S. PATENT DOCUMENTS 5,899,362 A * 5/1999 Moran ..... 222/136
6,065,649 A * 5/2000 Scoggins
6,109,482 A * 8/2000 Briggs

* cited by examiner

MOUNTABLE REUSABLE PAINT CONTAINER WITH SPIGOT ASSEMBLY AND STIRRING MECHANISM

FIELD OF THE INVENTION

The present invention generally relates to paint cans and containers. More specifically, the present invention relates to a reusable paint container for storing, mixing and dispensing paint products.

BACKGROUND OF THE INVENTION

Often, when painting the interior or exterior of a house, a person may use multiple colors including different colors for each room and different colors for wood trimmings around doorways, windows and on molding. Upon completion of painting a room or area within the interior or on the exterior of a house or building with a particular color, the person is typically left with at least one partially filled can of left over paint. Typically, persons with such left over paint, reseal the partially used paint container and store the left over paint in this container. Alternatively, the user may transfer the paint to another container for storage.

Often these partially used cans of paint are stored on the floor or on shelves in basements, garages, closets and cabinets. They may often also be stacked. One problem which exists with this manner of storage is convenience and maneuverability. Unsightly partially filled paint cans can clutter up valuable storage space. Moreover, if stacked, it is often difficult and/or time consuming to move every can in order to find a particular color of paint and then restack the remaining partially filled cans. Additionally, if the user needs to use some of the left over paint, the paint must be transferred to a different container and manually mixed before the paint is ready for use.

Another problem which exists with stored partially used cans of paint is that it is difficult to reseal the lid on the paint can properly. This can potentially lead to hazards such as the leakage of fumes through an improperly sealed lid and flammability when an improperly sealed can is stored in an area such as the garage, near a heater. Further, poorly sealed paint cans will also leak or spill paint when knocked over.

SUMMARY OF THE INVENTION

A mountable reusable paint container is configured for mounting on a wall and includes one or more separate storage compartments formed in a downward sloping configuration with each compartment having a spigot coupled at the base for dispensing the stored paint product. The paint container further includes molded air tight lids configured for fitting over each of the compartments. Each of the paint containers preferably have a stirring mechanism formed within the lid which extends into the paint container when the lid is positioned over the paint container. The stirring device extends downward into the reusable paint container and includes a top handle portion, a threaded distance rod and a bottom fin portion. The bottom fin portion includes a plurality of small evenly spaced fins formed of plastic which rotate with the stirring device in the paint container when the top handle portion is manually activated.

In one aspect of the invention, an apparatus for holding paint includes one or more paint storage compartments for storing paint having a front, a back, a first side, a second side and a base, a frame configured for holding the paint storage compartments and means for dispensing removeably coupled to the paint storage compartment for dispensing paint from the paint storage compartments. The frame is configured for holding a plurality of paint storage compartments. The means for dispensing paint includes a spigot assembly. The frame includes mounting slots in the back for mounting the frame on a wall. The apparatus for holding paint further includes a lid for selectively covering the paint storage compartment and means for stirring removeably coupled to the lid for stirring the paint stored in the paint storage compartment when the airtight lid is covering the paint storage compartment. The means for stirring further includes a circular base having a central axis, wherein the circular base is configured for rotating about the central axis, a rod coupled to the circular base at the central axis such that the rod spins when the circular base is rotated about the central axis and a stirring fan apparatus removeably coupled to the rod and having a plurality of fins which extend outwardly from the stirring fan apparatus and rotate about the central axis when the circular base is rotated for stirring the paint contained within the paint storage compartment.

In another aspect of the invention, an apparatus for storing paint includes a paint storage compartment for storing paint having a front, a back, a first side, a second side and a base, a frame configured for holding the paint storage compartment, a lid for covering the paint storage compartment and a stirring assembly removeably coupled to the lid for stirring the paint stored in the paint storage compartment when the lid is covering the paint storage compartment. The frame is configured for holding a plurality of paint storage compartments. The frame includes mounting slots in the back for mounting the frame on a wall. The stirring assembly includes a circular base configured for rotating about a central axis, a rod coupled to the circular base at the central axis such that the rod spins when the circular base is rotated about the central axis and a stirring fan apparatus removeably coupled to the rod for stirring paint contained within the paint storage compartment, wherein the stirring fan apparatus includes a plurality of fins which extend outwardly from the stirring fan apparatus and rotate about the central axis when the circular base is rotated.

In yet another aspect of the invention, an apparatus for storing paint includes a paint storage compartment for storing paint having a front, a back, a first side, a second side and a base, a frame configured for holding the paint storage compartment, a dispensing mechanism removeably coupled to the paint storage compartment for dispensing paint from the paint storage compartment, a lid for covering the paint storage compartment and a stirring assembly removeably coupled to the lid for stirring the paint stored in the paint storage compartment. The frame is further configured for holding a plurality of paint storage compartments. The dispensing mechanism preferably includes a spigot assembly. The frame includes mounting slots for mounting the frame on a wall. The stirring assembly includes a circular base configured for rotating about a central axis, a rod coupled to the circular base at the central axis such that the rod spins when the circular base is rotated about the central axis and a stirring fan apparatus removeably coupled to the rod and having a plurality of fins which extend outwardly from the stirring fan apparatus and rotate about the central axis when the circular base is rotated.

In still another aspect of the invention, a reusable paint container includes a paint compartment for storing paint, a body configured for holding the paint compartment having a front, a back, a first side and a second side, a lid removeably coupled to the paint compartment having an outer side, an inner opposite side and a small aperture located through the airtight lid from the outer side to the inner opposite side, a stirring mechanism removeably coupled to the outer side of the lid having an integrally formed rod located at a central axis of the stirring mechanism, wherein the rod is positioned through the small aperture in the lid to extend into the paint compartment when the lid is positioned over the paint compartment and a fan apparatus removeably coupled to the rod of the stirring mechanism on the inner opposite side of the lid. The body includes a plurality of mounting slots located on the back for mounting the main body to a wall. The stirring mechanism includes a handle for rotating the stirring mechanism about the central axis, thereby causing the fan apparatus to spin. An interior of the paint compartment has a sloped area and a reservoir area. The reservoir area includes a centrally located circular depression having a small hole located in the center of the circular depression, wherein the small hole is configured for coupling a spigot assembly to the paint compartment. The first side of the body includes rounded ribs and the second side of the body includes rounded channels such that multiple reusable paint containers can be connected together by coupling the rounded ribs to the rounded channels.

In still yet another aspect of the invention, a reusable paint container includes a body configured for holding paint within one or more integral paint compartments each having a front, a back, a first side and a second side, a lid removeably coupled to the paint compartments having an outer side, an inner opposite side and a small aperture located through the airtight lid from the outer side to the inner opposite side, a stirring mechanism removeably coupled to the outer side of the lid having an integrally formed rod located at a central axis of the stirring mechanism, wherein the rod is positioned through the small aperture in the lid to extend into a corresponding paint compartment when the lid is positioned over the corresponding paint compartment and a fan apparatus removeably coupled to the rod of the stirring mechanism on the inner opposite side of the lid. Within this embodiment, the paint compartments are single walled. The body includes a plurality of mounting slots located on the back for mounting the main body to a wall. The stirring mechanism includes a handle for rotating the stirring mechanism about the central axis, thereby causing the fan apparatus to spin. An interior of the paint compartments has a sloped area and a reservoir area. The reservoir area includes a centrally located circular depression having a small hole located in the center of the circular depression, wherein the small hole is configured for coupling a spigot assembly to the paint compartment. The first side of the body includes rounded ribs and the second side of the body includes rounded channels such that multiple reusable paint containers can be connected together by coupling the rounded ribs to the rounded channels.

DETAILED DESCRIPTION OF THE PREFERRED EMBODIMENT

The mountable reusable paint container of the present invention is configured for mounting on a wall and includes one or more separate paint storage compartments which are easily removed for cleaning or replacement. In the preferred embodiment of the present invention, the mountable reusable paint container includes three separate, removable paint storage compartments. Each of the paint storage compartments are preferably configured for attaching a spigot assembly through which the paint is dispensed from the container. Each of the paint storage compartments also includes an air tight lid with a built-in stirring assembly which can be manually operated to stir or mix the paint without removing the paint from the storage compartment.

Figure 1:
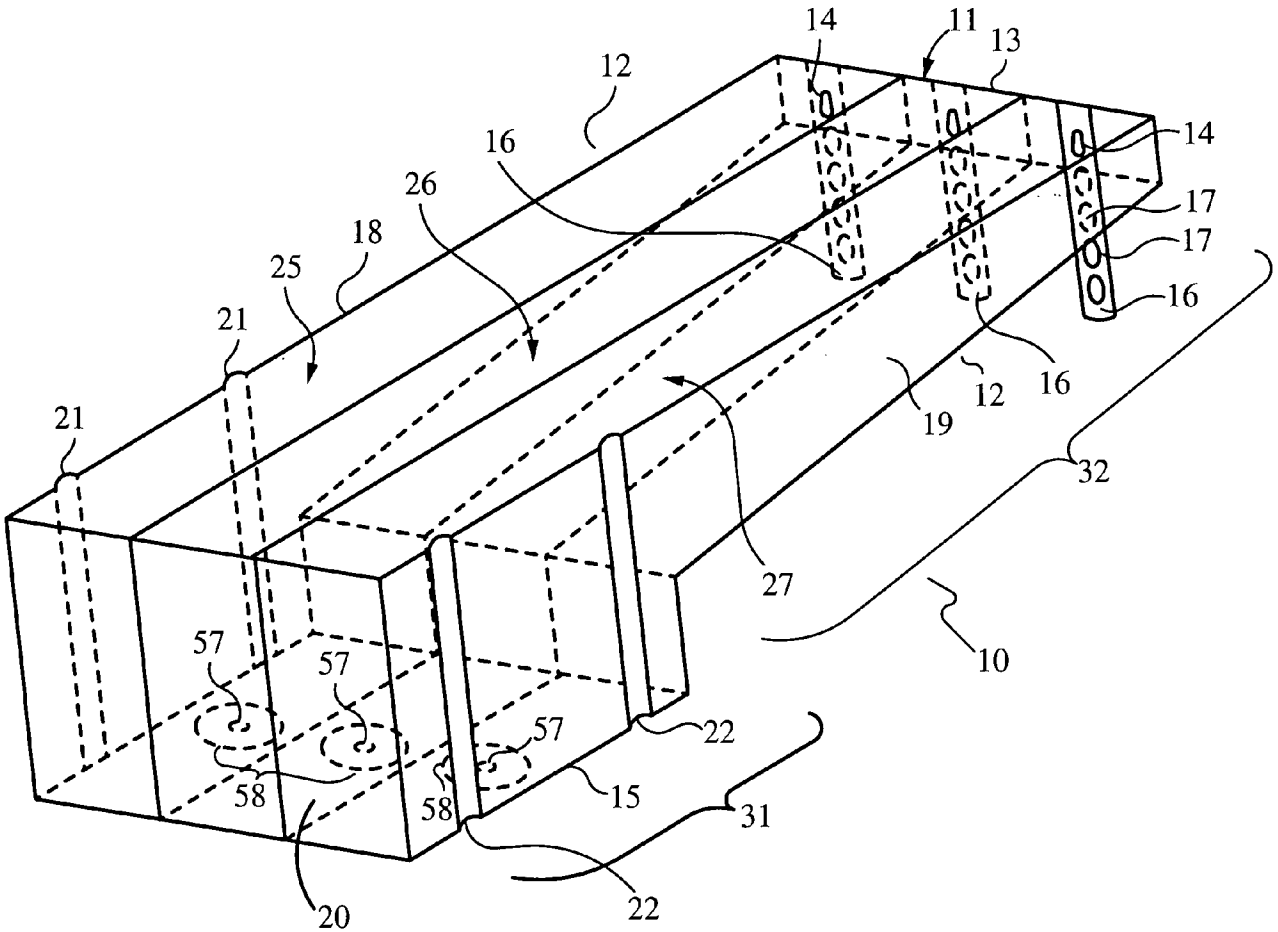
FIG. 1 illustrates a perspective view of the reusable paint container of the present invention.

FIG. 1 illustrates a perspective view of the reusable paint container of the present invention. The paint container includes a main body 10 with a hollow interior 11 and an exterior 12 having a front side 20, a first side 18, a second side 19, a back side 13 and a base 15. The hollow interior 11 of the main body 10 preferably includes three separate compartments 25, 26 and 27 each for holding a paint storage container. In an alternative embodiment, the three separate compartments 25, 26 and 27 form the paint storage containers. The base 15 is preferably configured to have an open area 31 and a solid area 32. The open area 31 allows for coupling spigot assemblies (not shown) to each of the three paint storage containers which are held in the separate compartments 25, 26 and 27. In the preferred embodiment of the present invention, the paint storage containers extend below the base 15 when held within the separate compartments 25, 26 and 27. In an alternative embodiment, the entire base 15 is solid, such that the entire base 15 encloses a single side of the main body 10, and integrally forms the paint storage containers within the separate compartments 25, 26 and 27. In this alternative embodiment, a portion of the base is configured with three centralized circular depressions 58 which each have a small drain hole 57 used for coupling spigot assemblies to each of the three storage compartments 25, 26 and 27.

A back side 13 of the main body 10 preferably includes three small circular shaped mounting slots 14 designed to slide over any mounting device such as a nail, hook or screw, for mounting the reusable paint container on the wall. Use of similar mounting slots for hanging paintings, pictures, wall speakers, candlestick holders and the like are well known in the art. Preferably, the mounting slots 14 are formed on the outside of the paint container and do not intrude into the interior of the paint container. In the preferred embodiment of the present invention, elongated support flanges 16 are further included to provide additional mounting support. Each elongated flange 16 has a number of holes 17 which align with the circular mounting slots 14. The flange may vary in length depending upon the height at which the main body 10 is to be mounted and the amount of support desired. This flange 16 is mounted to the wall and then used in conjunction with the mounting slots 14 to support the paint container in a mounted position.

The first side 18 of the main body 10 is preferably configured with a pair of thin rounded ribs 21 which extend along the height of the first side 18. It should be understood, that alternatively more than two ribs may be provided in alternate embodiments of the paint container of the present invention. The second side 19 of the main body 10 is preferably formed with a pair of thin rounded channels 22 which extend along the height of the second side 19 to correspond to the position of the pair of ribs 21. Once again, the number of channels may vary in alternate embodiments. The rounded ribs 21 are configured for mating with the rounded channels 22 such that multiple reusable paint containers may be mountably coupled to each other for mounting several paint containers together.

Figures 2, 2A:
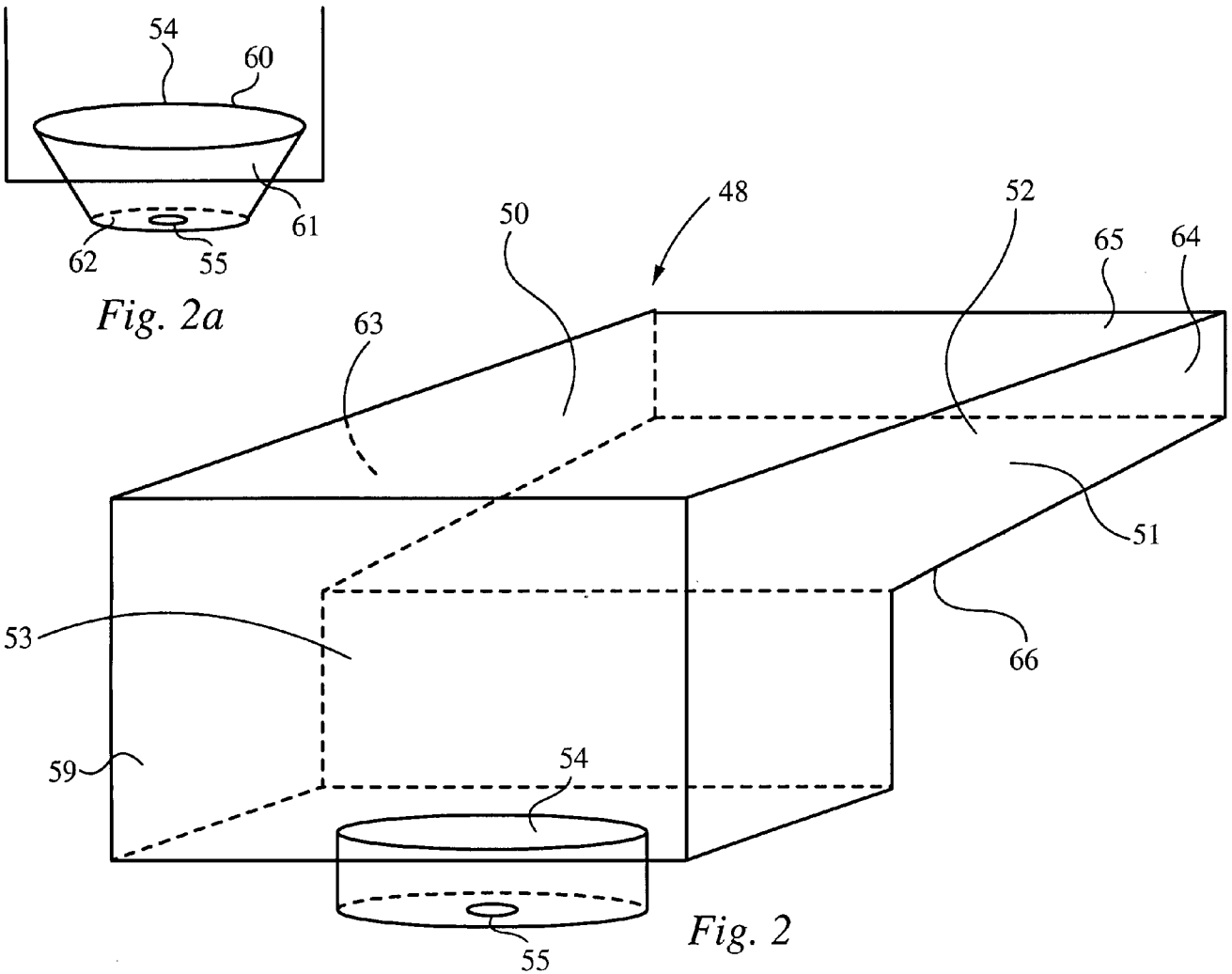
FIG. 2 illustrates a perspective view of a single compartment in the reusable paint container of the present invention.
FIG. 2*a* illustrates a side view of an alternative embodiment of a central circular depression in a single compartment of the reusable paint container of the present invention.

As previously described, the main body 10 of the reusable paint container is preferably designed for holding three separate paint storage containers. It should be understood by those skilled in the art that the main body 10 may have alternative configurations for holding more or less paint storage containers, as desired. FIG. 2 illustrates a perspective view of a single paint storage container 48 which fits within one of the separate compartments 25, 26 and 27 in the body of the paint container of the present invention. The paint storage container 48 is also designed in an L-shaped configuration with an interior portion 50 and an exterior shell 51 having a first side 63, a second side 64, a front 59, a back 65 and a base 66. The interior 50 includes a sloped area 52 and a reservoir area 53. The sloped area 52 is designed to direct liquid paint products poured into the interior portion 50 in a downwardly direction toward the reservoir area 53. The reservoir area 53 is preferably formed with a centrally located circular depression 54 and a small hole 55 in the center of the depression 55.

In the preferred embodiment of the present invention, the stirring fan apparatus includes three perforated fins 160 which are each coupled to the rod 157 at a second, opposite end 161 Each fin 160 is preferably separated by 120 degrees and is formed in the shape of a triangle. The perforated fins 160 extend outward from the rod 157 at a distance to fit within the circular depression 54 of the paint storage container 48. It is understood that in alternate embodiments, the stirring fan apparatus 156 may include more than three fins, with each fin being evenly spaced apart about the circumference of the rod 157. It is further understood that in alternate embodiments, the perforated fins may have alternate geometric shapes.

As described in the preferred embodiment, the base 15 (FIG. 1) of the main body (FIG. 1) is preferably configured to have an open area 31 and a solid area 32. The reservoir area 53 is designed to fit within this open area 31 such that the exterior shell 51 is exposed through the base 15 (FIG. 1) of the main body 10 (FIG. 1). This allows for coupling of spigot assemblies directly to each of the three paint storage containers 48 held within the separate compartments 25, 26 and 27. In an alternative embodiment, as described above, wherein the separate compartments 25, 26 and 27 are enclosed to form the paint storage containers, a portion of the base 15 is configured with three centralized circular depressions 58 which each have a small drain hole 57 for attaching the spigot assembly. It should be understood that in the preferred embodiment, the circular depression 54 is designed with a circumference large enough to surround the perforated fins of a stirring apparatus, as will be discussed in detail below.

In an alternative embodiment, as shown in FIG. 2*a*, the central circular depression 54 has a circular outer ridge 60 and a downward sloping cone-shaped inner surface 61 ending in a flat plane 62 with the hole 55 for attaching the spigot assembly located at the tip of the circular depression 54. This embodiment ensures that the liquid paint products stored within the paint storage compartment are directed toward the spigot assembly.

Figure 3:
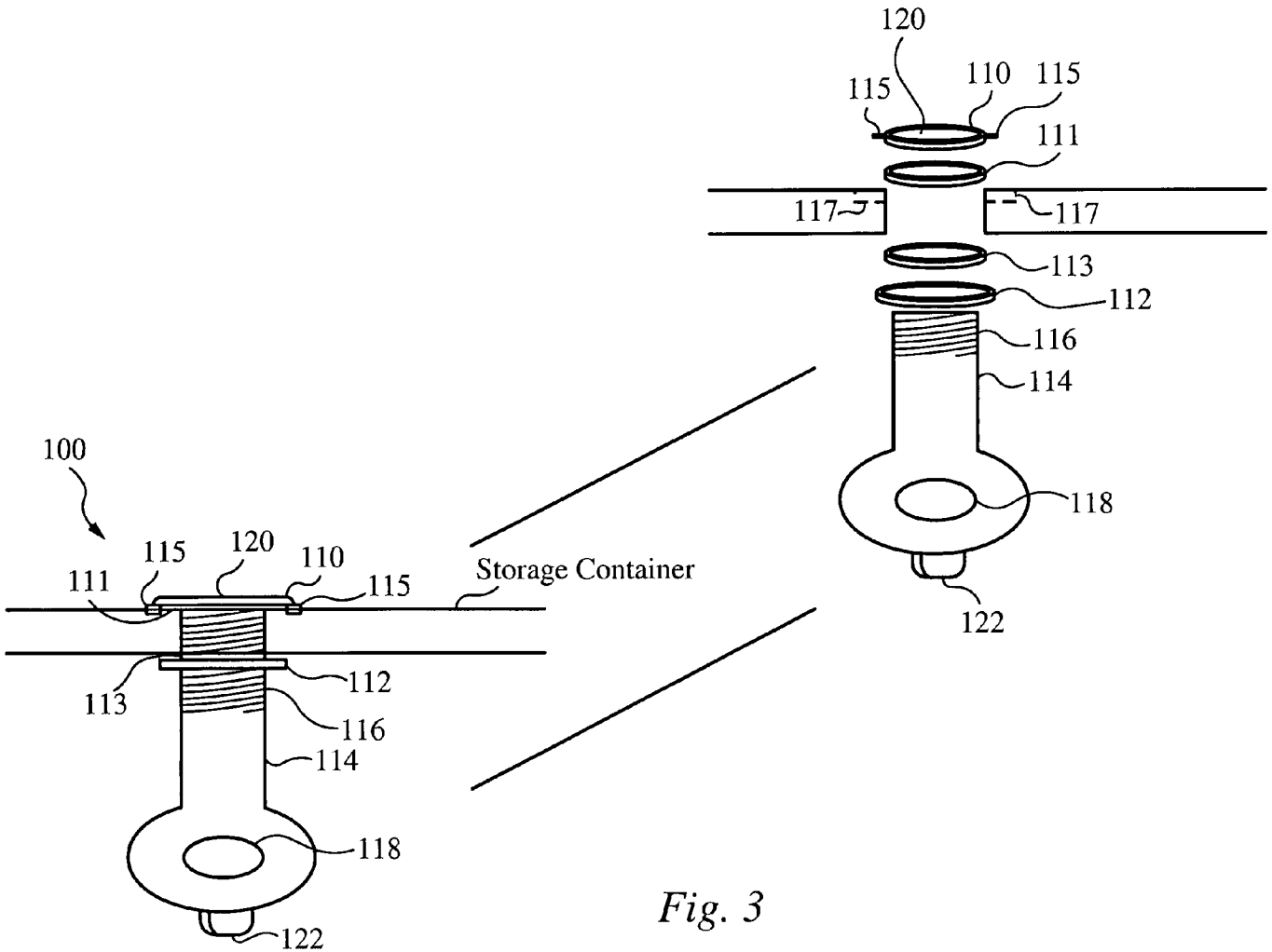
FIG. 3 illustrates a spigot assembly of the reusable paint container of the present invention.

As described earlier, the reusable paint container of the present invention preferably includes three separate compartments 25, 26 and 27, each for holding a paint storage container 48, with each paint storage container 48 configured for attaching a spigot assembly through which the paint stored within the paint storage container 48 is dispensed. FIG. 3 shows a spigot assembly of the preferred embodiment of the present invention. The spigot assembly 100 includes a top screw device 110 and a bottom screw device 112 which couple to the spigot body 114 to hold the spigot assembly 100 within the hole 55 of the paint storage container 48. The top screw device 110 and the bottom screw device 112 are both screwed onto a threaded portion 116 of the spigot body on either side of the paint storage container 48 to tighten the spigot assembly 100 to the paint storage container 48. A rubber sealing washer 111 is positioned between the top screw device 110 and the edge of the paint storage container 48. A rubber sealing washer 113 is positioned between the bottom screw device 112 and the edge of the paint storage container 48. Preferably, the top screw device 110 includes locking wings 115 which extend out from the top screw device 110 and fit within locking slots 117 in the paint storage container to provide tightening resistance when assembling the spigot assembly 100. Alternatively, the bottom screw device 112 or both the top and bottom screw devices 110 and 112 include tightening wings 115.

To assemble the spigot assembly 100 to the paint storage container 48, the bottom screw device 112 is first threaded onto the threaded portion 116. The rubber sealing washer 113 is then positioned over the bottom screw device 112. The threaded portion 116 is then positioned through the hole 55 in the paint storage container 48. Next, the rubber sealing washer 111 is positioned over the threaded portion 116 against the edge of the paint storage container 48. The top screw device 110 is then threaded onto the threaded portion 116. The top screw device 110 and the bottom screw device 112 are then tightened against the interior and the exterior, respectively, of the paint storage container 48 with the tightening wings 115 fitting into the locking slots 117. The spigot body 114 includes an aperture 120 and an interior through which the paint flows. The spigot body 114 also includes a push button 118 and a dispensing aperture 122 through which the paint is released from the paint storage container 48 when the push button 118 is pushed.

The spigot assembly 100 is designed to be easily removed for cleaning after each use. It should be understood that while the coupling of the spigot assembly 100 to the storage compartment has been described in terms of a screw device and threaded receiving end, alternative means for coupling the spigot assembly to the storage compartment are envisioned and remain within the spirit and scope of the invention. In an alternative embodiment, any other known appropriate spigot or dispensing assembly 100 may be used to dispense paint from the paint storage container 48, including a lever type spigot assembly with a similar threaded receiving end designed to couple with the elongated portion of the top screw device 110.

Figure 4:
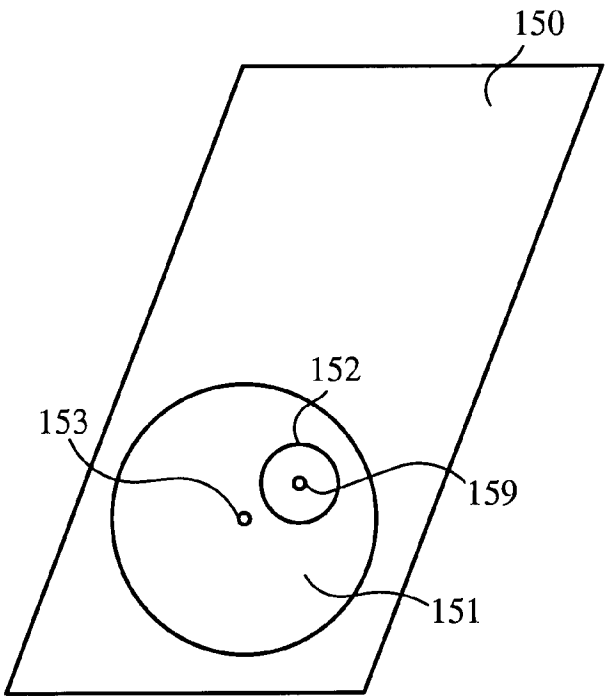
FIG. 4 illustrates a top view of a lid assembly for the reusable paint container of the present invention.

In the preferred embodiment of the present invention, the paint container also includes removable, air tight lid assemblies over each of the separate compartments 25, 26 and 27 to cover and protect the paint held within the paint storage compartments 48. Preferably, each of the lids include a stirring mechanism. FIG. 4 illustrates a top view of the lid assembly 150 for the reusable paint container of the preferred embodiment of the present invention. As shown, the lid assembly 150 is formed in a rectangular shape and designed to cover the outer periphery of the storage compartment so as to create an air tight seal. The lid assembly 150 includes a circular shaped stirring mechanism 151 which is configured for rotating about a central axis 153. The stirring mechanism 151 includes a small handle 152 on the top surface for manually rotating the stirring mechanism about the central axis 153. The handle 152 is preferably integrally formed as part of the stirring mechanism 151. Alternatively, the handle 152 is loosely coupled to the stirring mechanism 151 such that the handle 152 is able to rotate about its own axis 159 as the stirring mechanism is rotated about the central axis 153.

Figure 5:
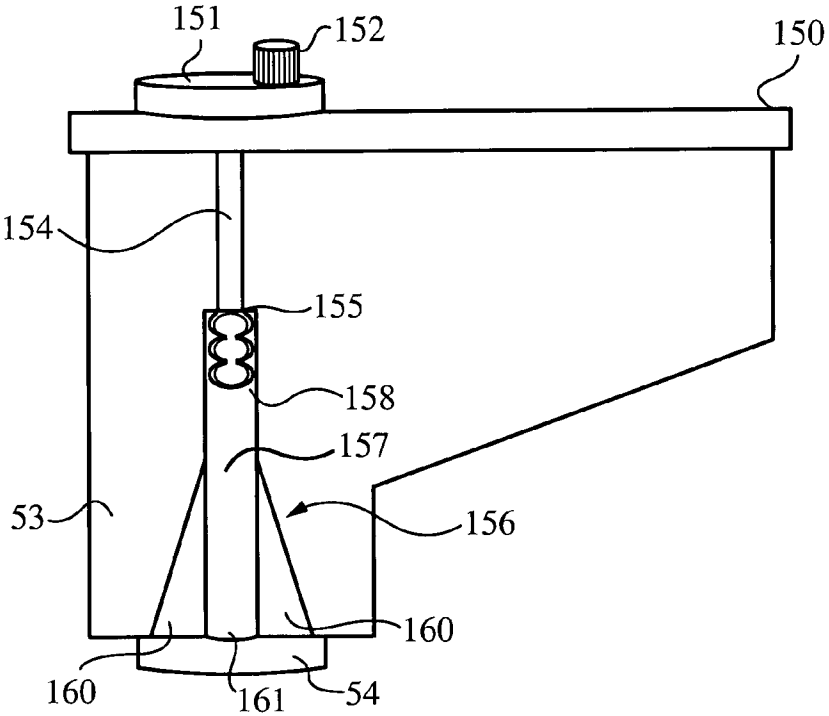
FIG. 5 illustrates a side view of a lid assembly and stirring mechanism for the reusable paint container of the present invention.

FIG. 5 illustrates a side view of the lid assembly 150 and stirring mechanism 151 of the preferred embodiment of the present invention. An aperture is formed within the lid assembly 150 through which an elongated rod 154, which is integrally formed as part of the stirring mechanism 151, is positioned such that the elongated rod 154 extends into the interior of the paint storage container when the lid assembly is placed over the paint storage container held in the separate compartment. The elongated rod 154 is removeably coupled to the stirring fan apparatus 156. The elongated rod 154 is preferably coupled to the stirring fan apparatus 156 by threading a lower portion 155 of the rod 154 and threading a hollow first end 158 of the rod 157, for receiving the threaded end of the elongated rod 152. In this way, the stirring fan apparatus can be easily removed for cleaning, as necessary.

In the preferred embodiment of the present invention, the stirring fan apparatus includes three perforated fins 160 which are each coupled to the rod 157 at a second, opposite end 161. Each fin 160 is preferably separated by 120 degrees and is formed in the shape of a triangle. The perforated fins 160 extend outward from the rod 157 at a distance to fit within the circular depression 54 of the paint storage container 48. It is understood that in alternate embodiments, the stirring fan apparatus 156 may include more than three fins, with each fin being evenly spaced apart about the 360 degree radius of the rod 157. It is further understood that in alternate embodiments, the perforated fins may have alternate geometric shapes.

Figure 6:
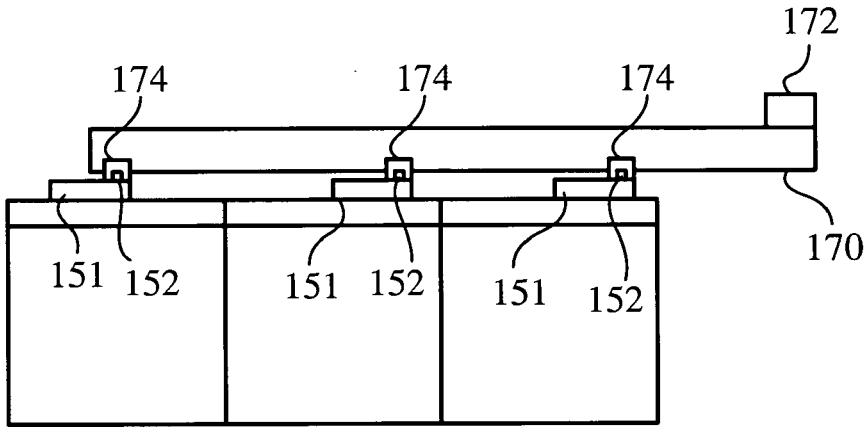
FIG. 6 illustrates a coupling arm for controlling the stirring mechanism within multiple paint containers.

FIG. 6 illustrates a coupling arm for controlling the stirring mechanism within multiple paint containers. The coupling arm 170 includes a handle 172 and multiple slots 174, each of which fit over a corresponding handle 152 of a stirring mechanism 151. Accordingly, by positioning the slots 174 of the coupling arm 170 over multiple handles 152, a user has the ability to simultaneously stir and mix paint within multiple paint containers by moving the handle 172 of the coupling arm 170.

In operation, using the handle 152 separately, or the coupling arm 170 with multiple paint containers, a user rotates the stirring mechanism 151 about the central axis 153 within each paint container. In this way, the elongated rod 154 and the rod 157 within a paint container spin in the same direction, thereby causing the perforated fins 160 to rotate and mix the paint stored within the paint storage container 48. The rod 157 is easily removed from the stirring mechanism 151 for cleaning the perforated fins 160 after each use.

In the alternative embodiment in which the paint storage containers are integrally formed within the separate compartments, the lids 150 fit over the separate compartments and the stirring mechanisms fit down into the separate compartments to stir the paint held within the separate compartments.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

Specifically, it will be apparent to one of ordinary skill in the art that the device of the present invention could be implemented in several different ways and the apparatus disclosed above is only illustrative of the preferred embodiment of the invention and is in no way a limitation. For example, it would be within the scope of the invention to alternate the sizes and shapes of the fins on the stirring fan apparatus. In addition, it will be apparent that a different type of dispensing mechanism, other than a push button spigot, could be interchanged without deviating from the spirit and scope of the present invention. Further, the paint container of the present invention can also be constructed with any appropriate number of separate compartments and paint storage containers.

I claim:

1. A paint storage container comprising:

a. a plurality of paint storage compartments each for storing paint having a front, a back, a first side, a second side and a base, wherein an interior of the paint compartments has a sloped area and a reservoir area, wherein the reservoir area includes a centrally located depression having a hole located in a center of the depression;

b. a frame holding the paint storage compartments; and c. means for dispensing removably coupled to the base of the paint storage compartments for dispensing paint from the paint storage compartments, wherein the means for dispensing is capable of dispensing paint without lifting the paint compartments.

2. The paint storage container as claimed in claim 1 wherein the means for dispensing paint includes a spigot assembly.

3. The paint storage container as claimed in claim 1 wherein the frame includes mounting slots for mounting the frame on a wall.

4. The paint storage container as claimed in claim 1 further comprising:

a. one or more lids covering the paint storage compartments; and b. means for stirring removably coupled to the lids for stirring the paint stored in the paint storage compartments.

5. The paint storage container as claimed in claim 4 wherein the means for stirring further comprises:

a. a circular base having a central axis, wherein the circular base is configured for rotating about the central axis;

b. a rod coupled to the circular base at the central axis such that the rod spins when the circular base is rotated about the central axis; and c. a stirring fan apparatus removably coupled to the rod and having a plurality of fins which extend outwardly from the stirring fan apparatus and rotate about the central axis when the circular base is rotated for stirring the paint contained within the paint storage compartments.

6. The paint storage container as claimed in claim 1 wherein the means for dispensing has a size sufficient for paint to flow through.

7. A paint storage container comprising:

a. a plurality of paint storage compartments each for storing paint and each having a front, a back, a planar first side, a planar second side and a base, wherein an interior of the paint compartments has a sloped area and a reservoir area, wherein the reservoir area includes a centrally located depression having a hole located in a center of the depression;

b. a frame holding the paint storage compartments;

c. one or more lids covering the paint storage compartments;

d. a stirring assembly removably coupled to the lids for stirring the paint stored in the paint storage compartments; and e. a dispensing mechanism removably coupled to the base of the paint storage compartments to dispense paint from the paint storage compartments, wherein the dispensing mechanism is capable of dispensing paint without lifting the paint compartments.

8. The paint storage container as claimed in claim 7 wherein the frame includes mounting slots for mounting the frame on a wall.

9. The paint storage container as claimed in claim 7 wherein the stirring assembly comprises:

a. a circular base configured for rotating about a central axis;

b. a rod coupled to the circular base at the central axis such that the rod spins when the circular base is rotated about the central axis;

c. a stirring fan apparatus removably coupled to the rod for stirring paint contained within the paint storage compartments, wherein the stirring fan apparatus includes a plurality of fins which extend outwardly from the stirring fan apparatus and rotate about the central axis when the circular base is rotated.

10. The paint storage container as claimed in claim 7 wherein the dispensing mechanism has a size sufficient for paint to flow through.

11. A paint storage container comprising:

a. a plurality of paint storage compartments each for storing paint and each having a front, a back, a first side, a second side and a base, wherein an interior of the paint compartments has a sloped area and a reservoir area, wherein the reservoir area includes a centrally located depression having a hole located in a center of the depression, wherein the hole is for coupling a spigot assembly to the paint compartment;

b. a frame holding the paint storage compartments;

c. a dispensing mechanism removably coupled to the base of the paint storage compartments for dispensing paint from the paint storage compartments, wherein the dispensing mechanism is capable of dispensing paint without lifting the paint compartments;

d. one or more lids covering the paint storage compartments; and e. a stirring assembly removably coupled to the lids for stirring the paint stored in the paint storage compartments.

12. The paint storage container as claimed in claim 11 wherein the frame includes mounting slots for mounting the frame on a wall.

13. The paint storage container as claimed in claim 11 wherein the stirring assembly comprises:

a. a circular base configured for rotating about a central axis;

b. a rod coupled to the circular base at the central axis such that the rod spins when the circular base is rotated about the central axis; and c. a stirring fan apparatus removably coupled to the rod and having a plurality of fins which extend outwardly from the stirring fan apparatus and rotate about the central axis when the circular base is rotated.

14. The paint storage container as claimed in claim 11 wherein the dispensing mechanism has a size sufficient for paint to flow through.

15. A reusable paint container comprising:

a. a plurality of paint compartments each for storing paint and each having a first front, a first back, a first side, a second side and a base, wherein an interior of the paint compartments has a sloped area and a reservoir area, wherein the reservoir area includes a centrally located depression having a hole located in a center of the depression, wherein the hole is for coupling a spigot assembly to the paint compartment;

b. a body holding the paint compartments having a second front, a second back, a planar third side and a planar fourth side;

c. one or more lids removably coupled to the paint compartments having an outer side, an inner opposite side and an aperture located through the lid from the outer side to the inner opposite side;

d. a stirring mechanism removably coupled to the outer side of the lids having an integrally formed rod located at a central axis of the stirring mechanism, wherein the rod is positioned through the aperture in the lids to extend into the paint compartment;

e. a fan apparatus removably coupled to the rod of the stirring mechanism on the inner opposite side of the lids; and f. a dispensing mechanism removably coupled to the base of the paint storage compartments to dispense paint from the paint storage compartments, wherein the dispensing mechanism is capable of dispensing paint without lifting the paint compartments.

16. The reusable paint container as claimed in claim 15 wherein the body includes a plurality of mounting slots located on the back for mounting the body to a wall.

17. The reusable paint container as claimed in claim 15 wherein the stirring mechanism includes a handle for rotating the stirring mechanism about the central axis, thereby causing the fan apparatus to spin.

18. The reusable paint container as claimed in claim 15 wherein the dispensing mechanism has a size sufficient for paint to flow through.

19. The reusable paint container as claimed in claim 15 wherein the first side of the body includes rounded ribs and the second side of the body includes rounded channels such that multiple reusable paint containers can be connected together by coupling the rounded ribs to the rounded channels.

20. A reusable paint container comprising:

a. a plurality of paint compartments for storing paint, wherein an interior of the paint compartments has a sloped area and a reservoir area, wherein the reservoir area includes a centrally located circular depression having a hole located in the center of the circular depression, wherein the hole is for coupling a spigot assembly to the paint compartment;

b. a body holding the paint compartments having a front, a back, a planar first side and a planar second side;

c. one or more lids removably coupled to the paint compartments having an outer side, an inner opposite side and an aperture located through the lid from the outer side to the inner opposite side;

d. a stirring mechanism removably coupled to the outer side of the lids having an integrally formed rod located at a central axis of the stirring mechanism, wherein the rod is positioned through the aperture in the lids to extend into the paint compartment; and e. a fan apparatus removably coupled to the rod of the stirring mechanism on the inner opposite side of the lids.

21. A reusable paint container comprising:

a. a body having a first side, a second side, and a plurality of integral paint compartments, each of the paint compartments having a front, a back, a planar first side, a planar second side and a base, wherein an interior of the paint compartments has a sloped area and a reservoir area, wherein the reservoir area includes a centrally located depression having a hole located in a center of the depression, wherein the hole is for coupling a spigot assembly to the paint compartment;

b. one or more lids removably coupled to the paint compartments each having an outer side, an inner opposite side and an aperture located through the lid from the outer side to the inner opposite side;

c. a stirring mechanism removably coupled to the outer side of the lids having an integrally formed rod located at a central axis of the stirring mechanism, wherein the rod is positioned through the aperture in the lids extending into a corresponding paint compartment;

d. a fan apparatus removably coupled to the rod of the stirring mechanism on the inner opposite side of the lid; and e. a dispensing mechanism removably coupled to the base of the paint compartments to dispense paint from the paint compartments, wherein the dispensing mechanism is capable of dispensing paint without lifting the paint compartments.

22. The reusable paint container as claimed in claim 21 wherein the paint compartments are single walled.

23. The reusable paint container as claimed in claim 21 wherein the integral paint compartments include a plurality of mounting slots located on the back for mounting the body to a wall.

24. The reusable paint container as claimed in claim 21 wherein the stirring mechanism includes a handle for rotating the stirring mechanism about the central axis, thereby causing the fan apparatus to spin.

25. The reusable paint container as claimed in claim 21 wherein the first side of the body includes rounded ribs and the second side of the body includes rounded channels such that multiple reusable paint containers can be connected together by coupling the rounded ribs to the rounded channels.

26. The reusable paint container as claimed in claim 21 wherein the dispensing mechanism has a size sufficient for paint to flow through.

27. A reusable paint container comprising:

a. a body having a first side, a second side, and a plurality of integral paint compartments, each of the paint compartments having a front, a back, a planar first side and a planar second side, wherein an interior of the paint compartments has a sloped area and a reservoir area, wherein the reservoir area includes a centrally located circular depression having a hole located in the center of the circular depression, wherein the hole is for coupling a spigot assembly to the paint compartment;

b. one or more lids removably coupled to the paint compartments each having an outer side, an inner opposite side and an aperture located through the lid from the outer side to the inner opposite side;

c. a stirring mechanism removably coupled to the outer side of the lids having an integrally formed rod located at a central axis of the stirring mechanism, wherein the rod is positioned through the aperture in the lids extending into a corresponding paint compartment; and d. a fan apparatus removably coupled to the rod of the stirring mechanism on the inner opposite side of the lid.

28. A paint storage container comprising:

a. one or more colors of paint;

b. a plurality of paint storage compartments each for storing a color paint, each paint storage compartment having a front, a back, a first side, a second side and a base, wherein an interior of the paint compartments has a sloped area and a reservoir area, wherein the reservoir area includes a centrally located depression having a hole located in a center of the depression, wherein the hole is for coupling a spigot assembly to the paint compartment;

c. a frame holding the paint storage compartments; and d. a dispensing mechanism coupled to the base of the paint storage compartments for dispensing paint from the paint storage compartments, wherein the dispensing mechanism is capable of dispensing paint without lifting the paint compartments.

* * * * *